US006677909B2

(12) United States Patent
Sun et al.

(10) Patent No.: US 6,677,909 B2
(45) Date of Patent: Jan. 13, 2004

(54) DUAL BAND SLOT ANTENNA WITH SINGLE FEED LINE

(75) Inventors: Pei-Lun Sun, Tu-chen (TW); Hsin Kuo Dai, Tu-Chen (TW); Chien-Hsun Huang, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/016,887

(22) Filed: Dec. 13, 2001

(65) Prior Publication Data

US 2003/0090426 A1 May 15, 2003

(30) Foreign Application Priority Data

Nov. 9, 2001 (TW) ..... 90219300

(51) Int. Cl.[7] ..... H01Q 13/10
(52) U.S. Cl. ..... 343/767; 343/770

(58) Field of Search ..... 343/767, 770

(56) References Cited

U.S. PATENT DOCUMENTS 6,218,997 B1 * 4/2001 Lindenmeier et al. ..... 343/770

* cited by examiner

*Primary Examiner*—Michael C. Wimer
(74) *Attorney, Agent, or Firm*—Wei Te Chung

(57) ABSTRACT

A dual band slot antenna (1) for an electronic device includes an antenna body (10) with elongated first and second slots (11, 12) defined therein and a coaxial feeder cable (20) having a conductive inner core wire (21) and a conductive outer shield (22). The inner core wire is electrically connected to the antenna body at an outer side of the first slot 11 and the outer shield is electrically connected to the antenna body at an opposite, outer side of the second slot. The coaxial cable acts as a common feed line of the first and second slots.

16 Claims, 12 Drawing Sheets

Scale: 5 dBi/div
Operating Frequency: 2.4375 GHz
Horizontally Polarized

Scale: 5 dBi/div
Operating Frequency: 2.4375 GHz
Vertically Polarized

DUAL BAND SLOT ANTENNA WITH SINGLE FEED LINE

FIELD OF THE INVENTION

The present invention relates to a dual band slot antenna, and in particular to a dual band slot antenna with a single feed line.

BACKGROUND OF THE INVENTION

There is a growing need for dual band antennas for use in wireless communication devices to adapt the devices to dual band operation. Referring to FIG. 1, a conventional dual band slot antenna comprises an antenna body 101 made from a metal foil, a first and second closed-circle slots 11, 12 defined in the antenna body, and a first and second coaxial cables 30, 50 electrically connecting with the antenna body 101, wherein the first coaxial cable 30 has an inner core wire and an outer shield respectively soldered to two sides of the first slot 11 to act as a feeder of the first slot 11, and the second coaxial cable 50 has an inner core wire and an outer shield respectively soldered to two sides of the second slot 12 to act as a feeder of the second slot 12. With such a structure, the antenna can operate in two different frequency bands using by the two different slots 11, 12 with the two feeders 30, 50.

However, since this arrangement requires two coaxial cables, such dual band slot antenna will occupy more installation space. Furthermore, the second coaxial cable adds manufacturing cost.

Hence, an improved antenna is desired to overcome the above-mentioned shortcomings of existing antennas.

BRIEF SUMMARY OF THE INVENTION

A primary object, therefore, of the present invention is to provide an improved dual band slot antenna with a single feed line to save installation space and manufacturing cost.

A slot antenna in accordance with the present invention comprises an antenna body with elongated first and second slots defined therein and a coaxial feeder cable having a conductive inner core wire and a conductive outer shield. The inner core wire is electrically connected to the antenna body at an outer side of the first slot and the outer shield is electrically connected to the antenna body at an outer side of the second slot. The coaxial cable acts as a common feed line of the first and second slots.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
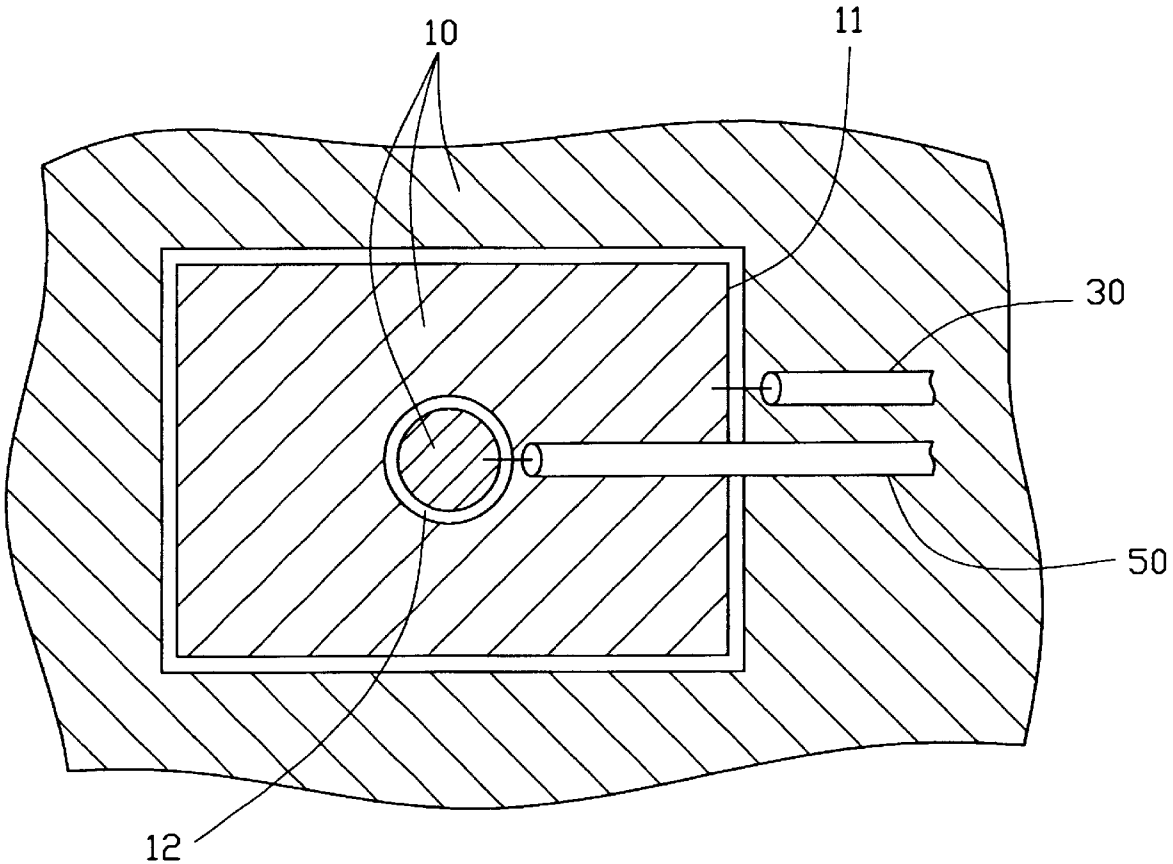
FIG. 1 (PRIOR ART)
FIG. 1 is a top view of a conventional slot antenna.
Figure 2:
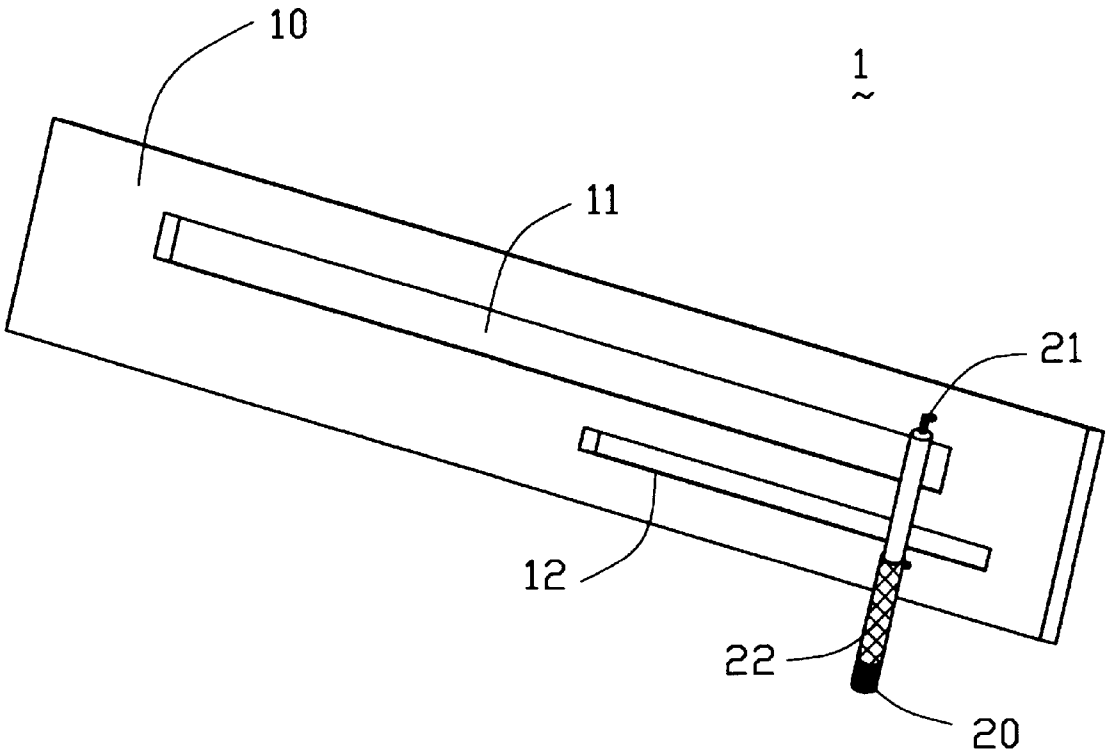
FIG. 2 is an assembled view of a preferred embodiment of a dual band slot antenna in accordance with the present invention.

Referring to FIG. 2, a dual band slot antenna 1 in accordance with the present invention comprises an antenna body 10 and a coaxial feeder cable 20 electrically connected to the antenna body 10.

The antenna body 10 is made from a metal foil. Elongated, narrow first and second slots 11, 12 are defined in the antenna body 10 and run parallel with each other.

The coaxial feeder cable 20 comprises a conductive inner core 21 and a conductive braiding layer 22 separated by a dielectric layer (not labeled). The inner core 21 and the braiding layer 22 are respectively soldered to the antenna body 10 at an outer side of the first slot 11 and at an opposite, outer side of the second slot 12.

Figure 3:
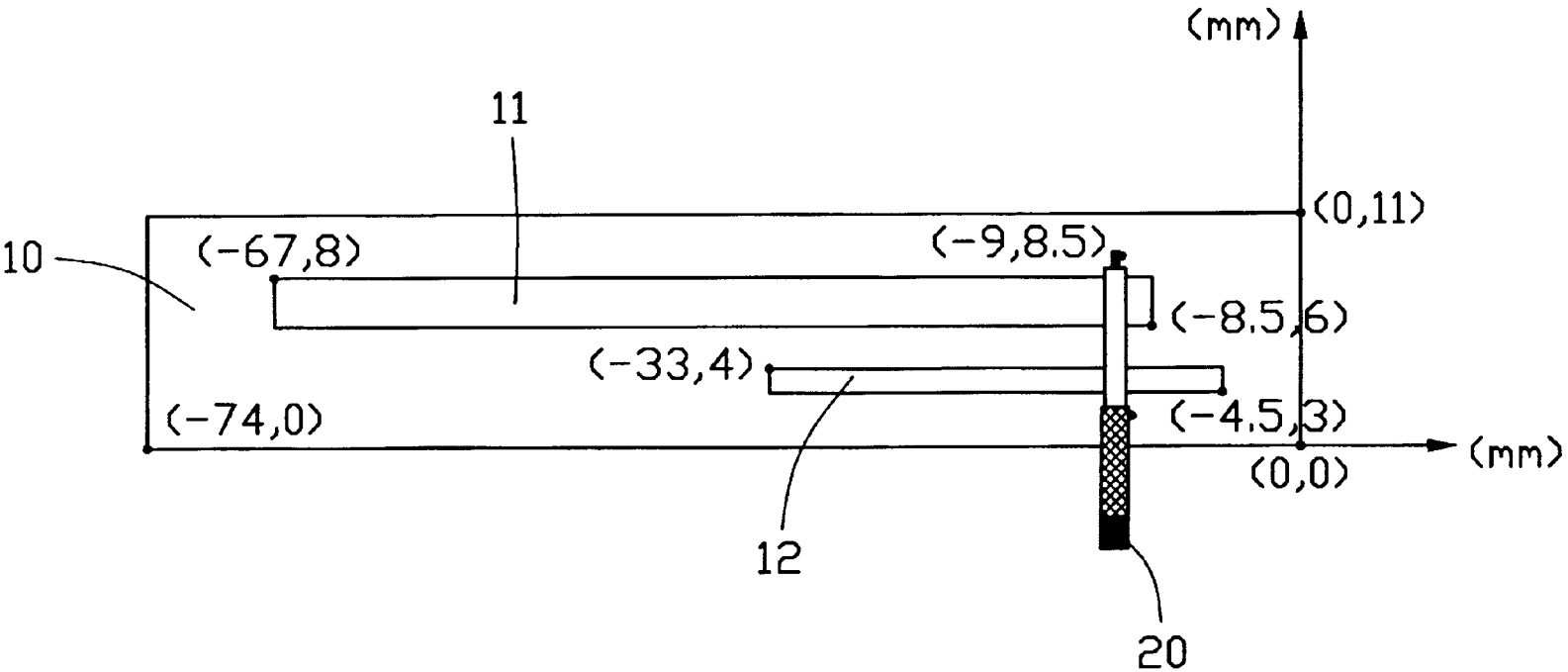
FIG. 3 is a top view illustrating dimensions of the dual band antenna of FIG. 2 drawn on a system of Cartesian coordinates.

Referring to FIG. 3, the first and second slots 11, 12 have different dimensions and can operate in different frequency bands. The coaxial cable 20 acts as a common feed line of the first and second slots 11, 12.

Figure 4:
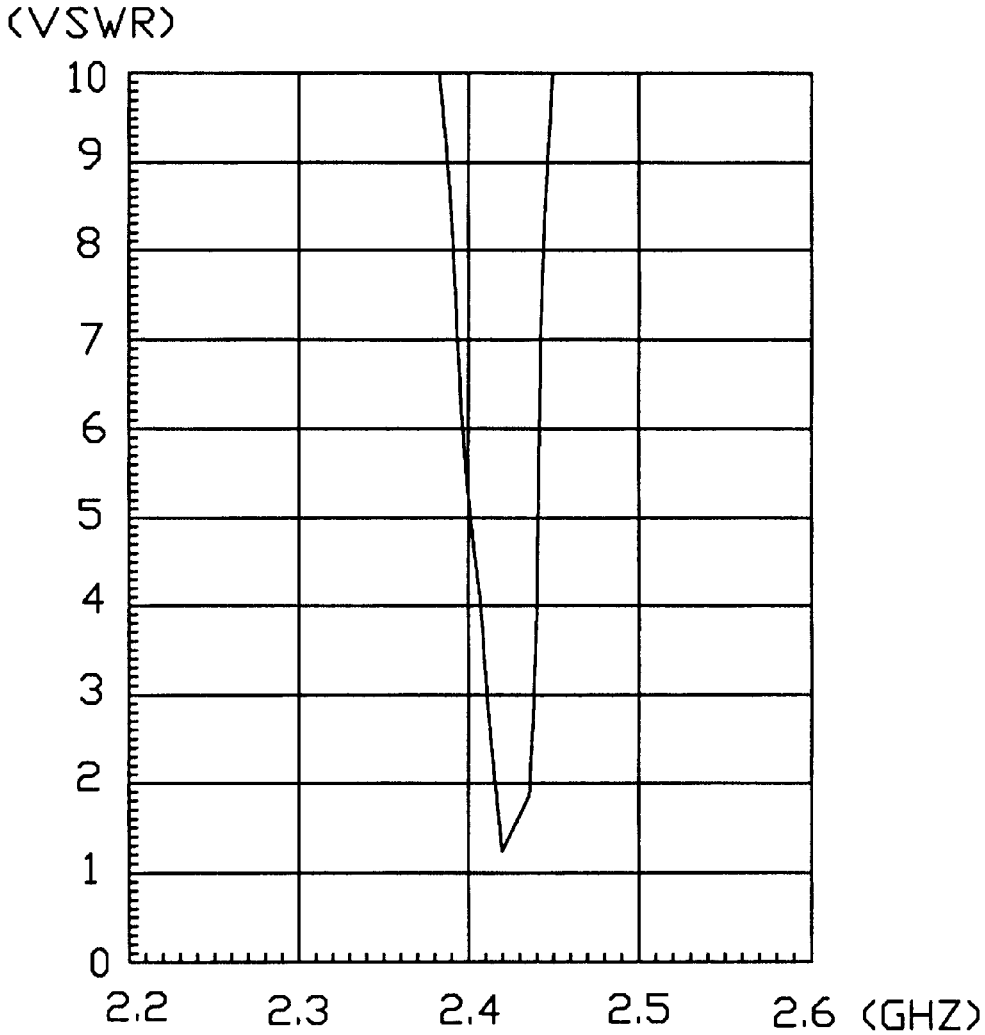
FIG. 4 is a test chart for the dual band antenna of FIG. 2, wherein the operating frequency varies around 2.45 GHz, with the vertical axis indicating Voltage Standing Wave Ratio (VSWR), and the horizontal axis indicating frequency.
Figure 5:
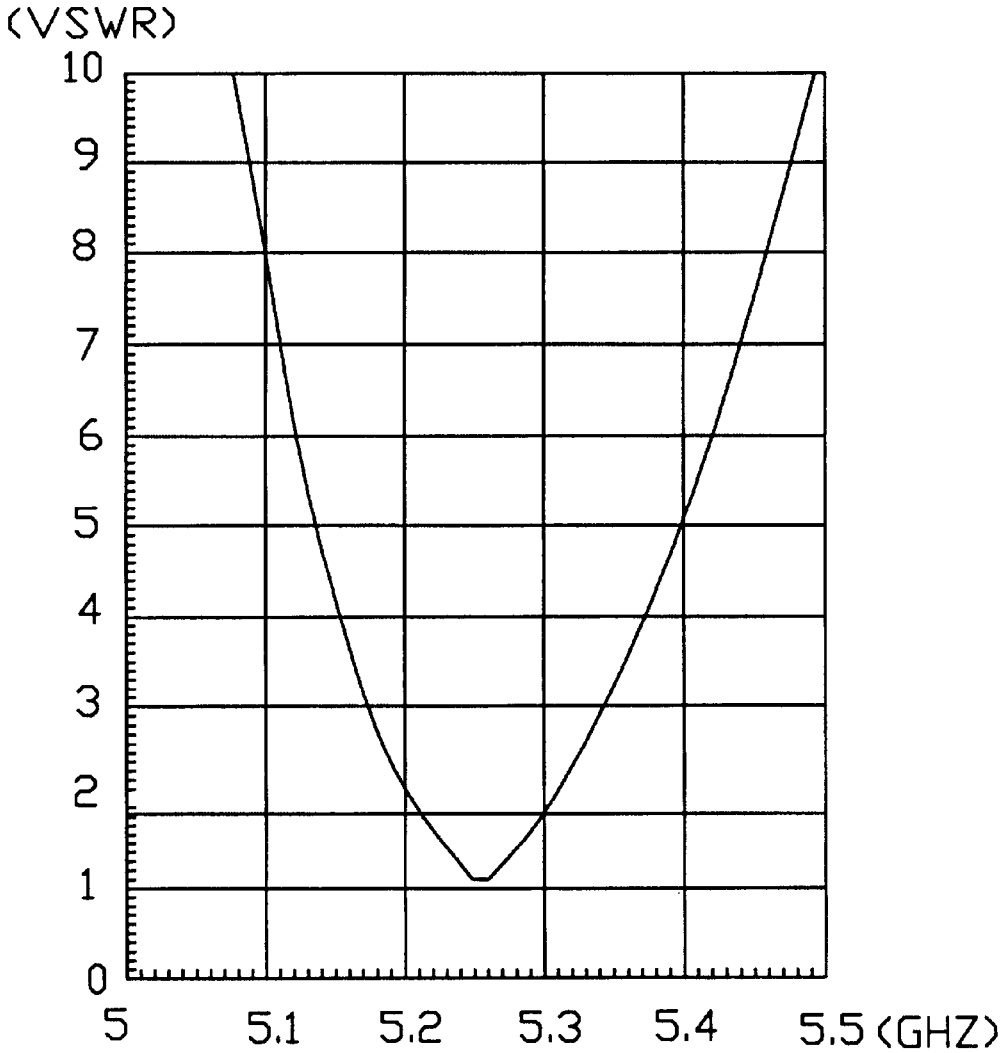
FIG. 5 is another test chart for the dual band antenna of FIG. 2, wherein the operating frequency varies around 5.25 GHz, and the vertical axis indicates Voltage Standing Wave Ratio (VSWR), while the horizontal axis indicates frequency.
Figure 6:
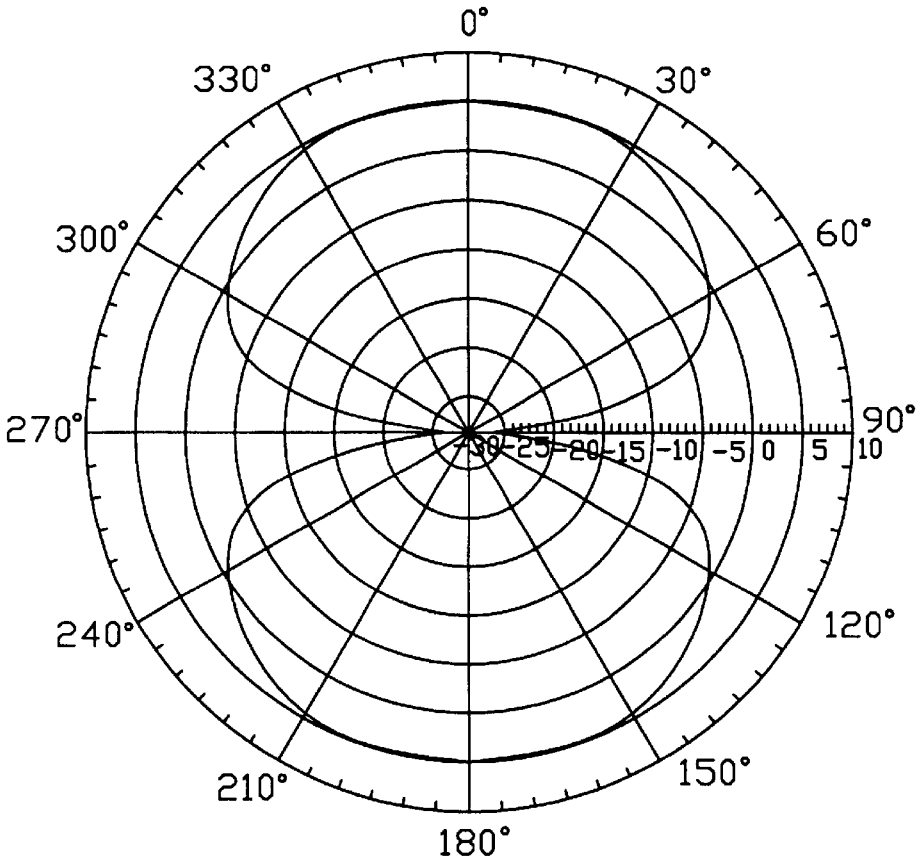
FIG. 6 is a graph of a horizontally polarized principle plane radiation pattern of the dual band slot antenna of FIG. 2 operating at a frequency of 2437.5 MHz.
Figure 7:
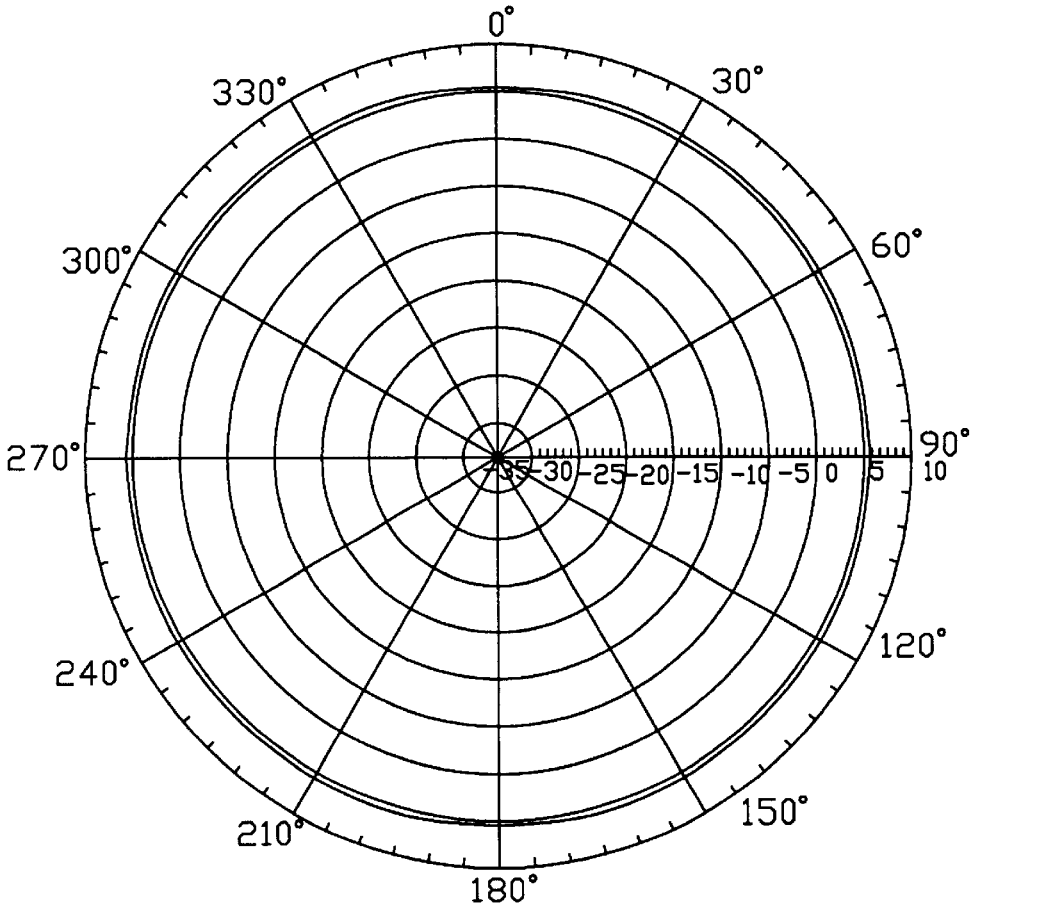
FIG. 7 is a graph of a vertically polarized principle plane radiation pattern of the dual band slot antenna of FIG. 2 operating at a frequency of 2437.5 MHz.
Figure 8:
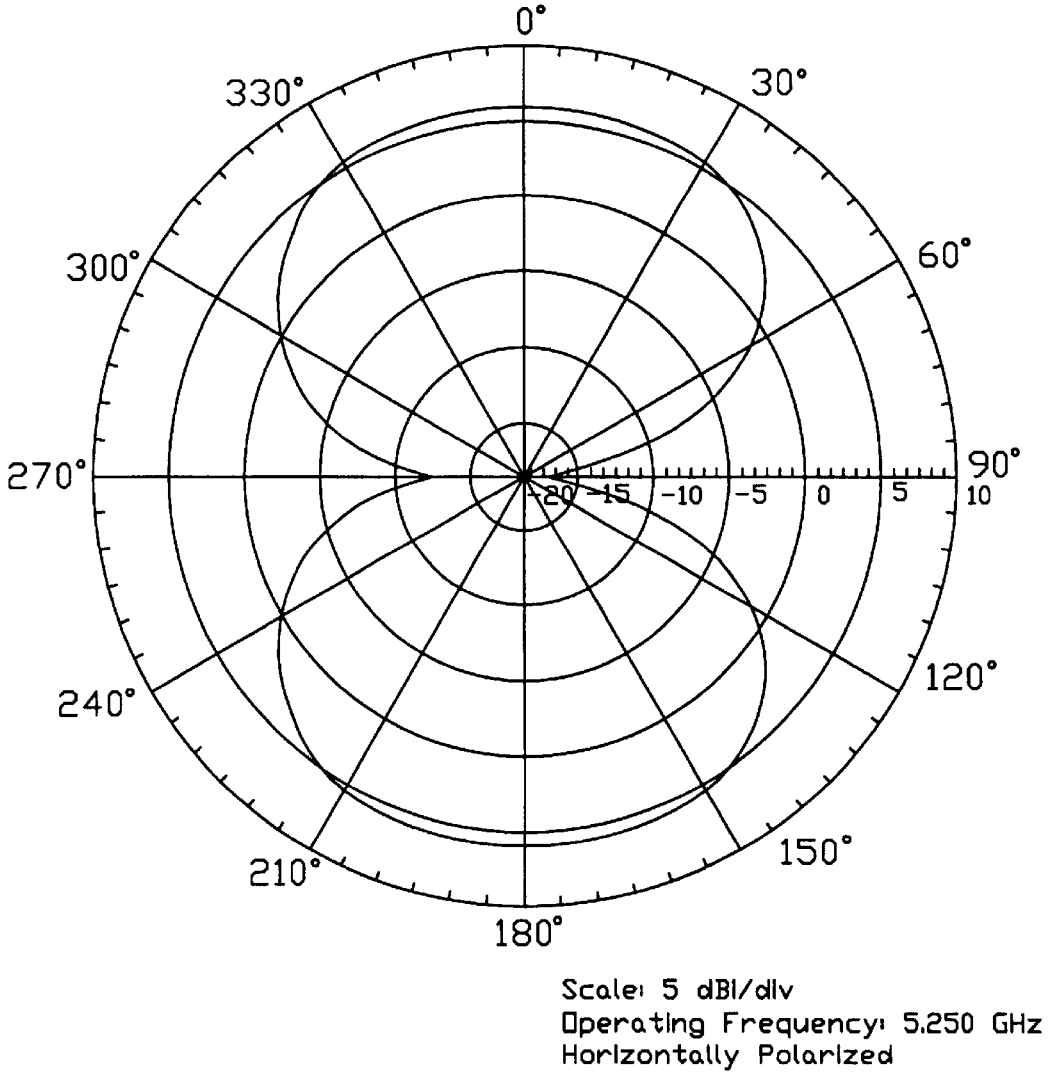
FIG. 8 is a graph of a horizontally polarized principle plane radiation pattern of the dual band slot antenna of FIG. 2 operating at a frequency of 5250.0 MHz.
Figure 9:
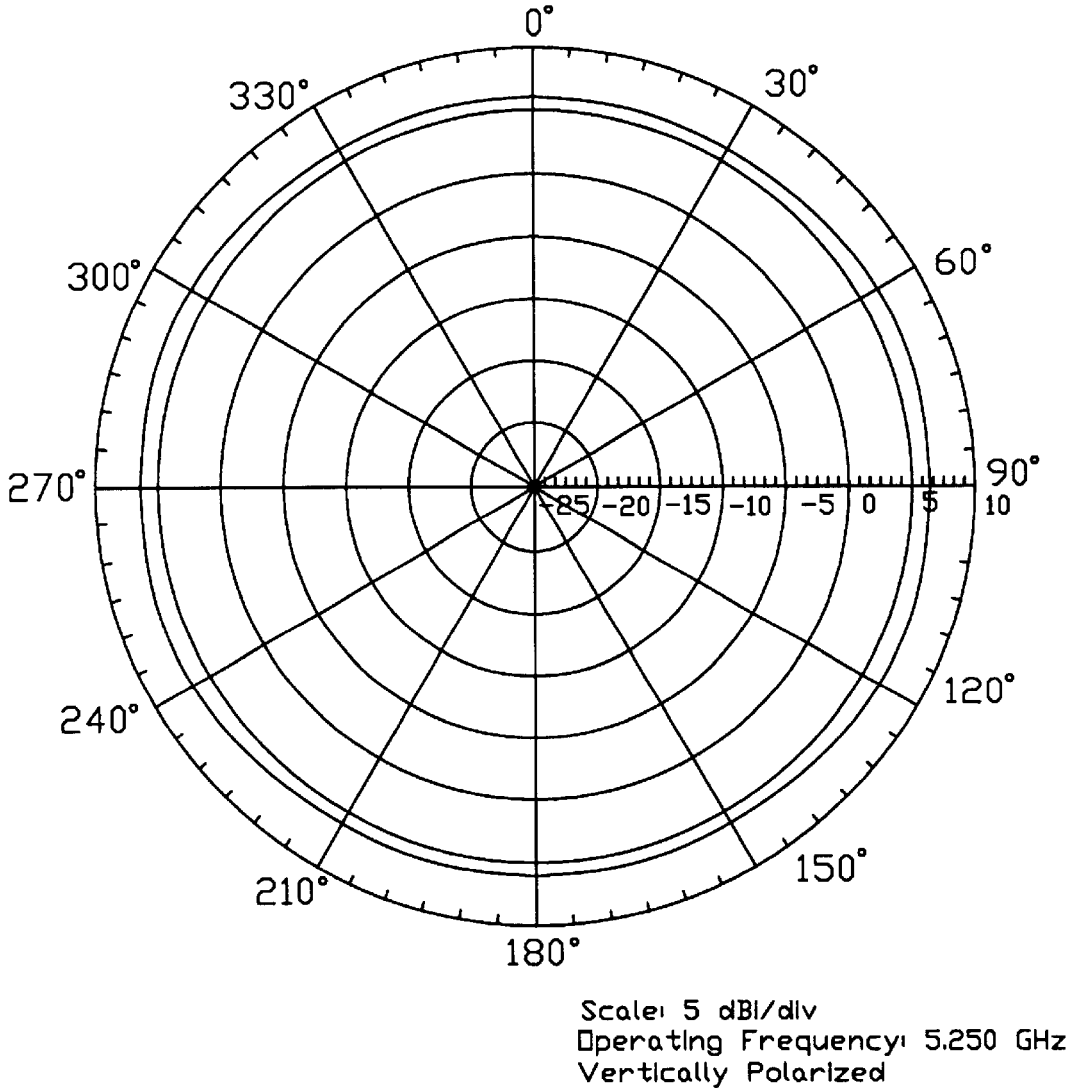
FIG. 9 is a graph of a vertically polarized principle plane radiation pattern of the dual band slot antenna of FIG. 2 operating at a frequency of 5250.0 MHz.

FIGS. 4 and 5 respectively show Voltage Standing Wave Ratios (VSWR) in test charts of the dual band slot antenna 1 operating in the 2.45 GHz frequency band and in the 5.25 GHz frequency band. It is noted that there is a range of frequencies in both graphs wherein the values of VSWR are below "2", so the dual band antenna 1 can meet VSWR requirement both in the 2.45 GHz frequency band and in the 5.25 GHz frequency band.

FIGS. 6, 7, 8 and 9 alternatingly show horizontally and vertically polarized principle plane radiation patterns of the dual band slot antenna 1 operating at frequencies of 2.4375 GHz and 5.250 GHz. Note that these radiation patterns are close to idealized radiation patterns.

Figure 10:
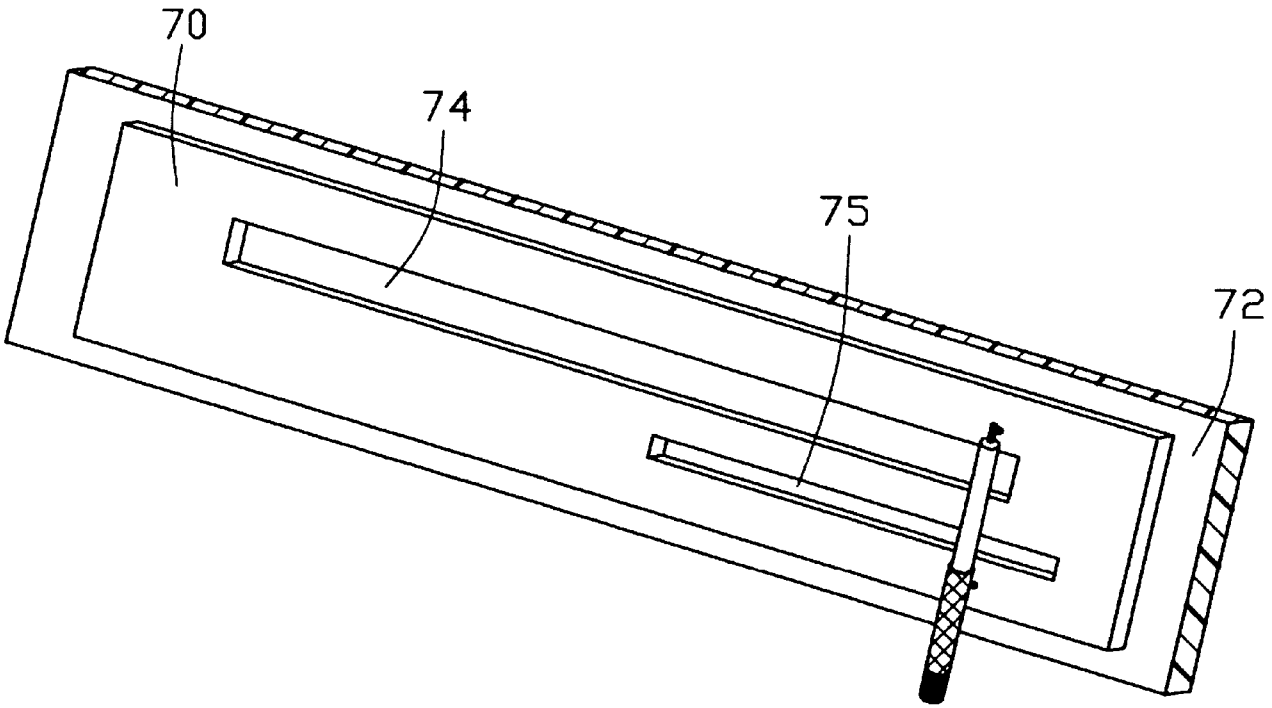
FIG. 10 is an assembled view of a second embodiment of a dual band slot antenna in accordance with the present invention.

Referring to FIG. 10, using the principles disclosed above, the present invention can be implemented by etching slots 74, 75 in a copper cladding layer antenna body 70 deposited on a top surface of a printed circuit board (PCB) substrate 72.

Figure 11:
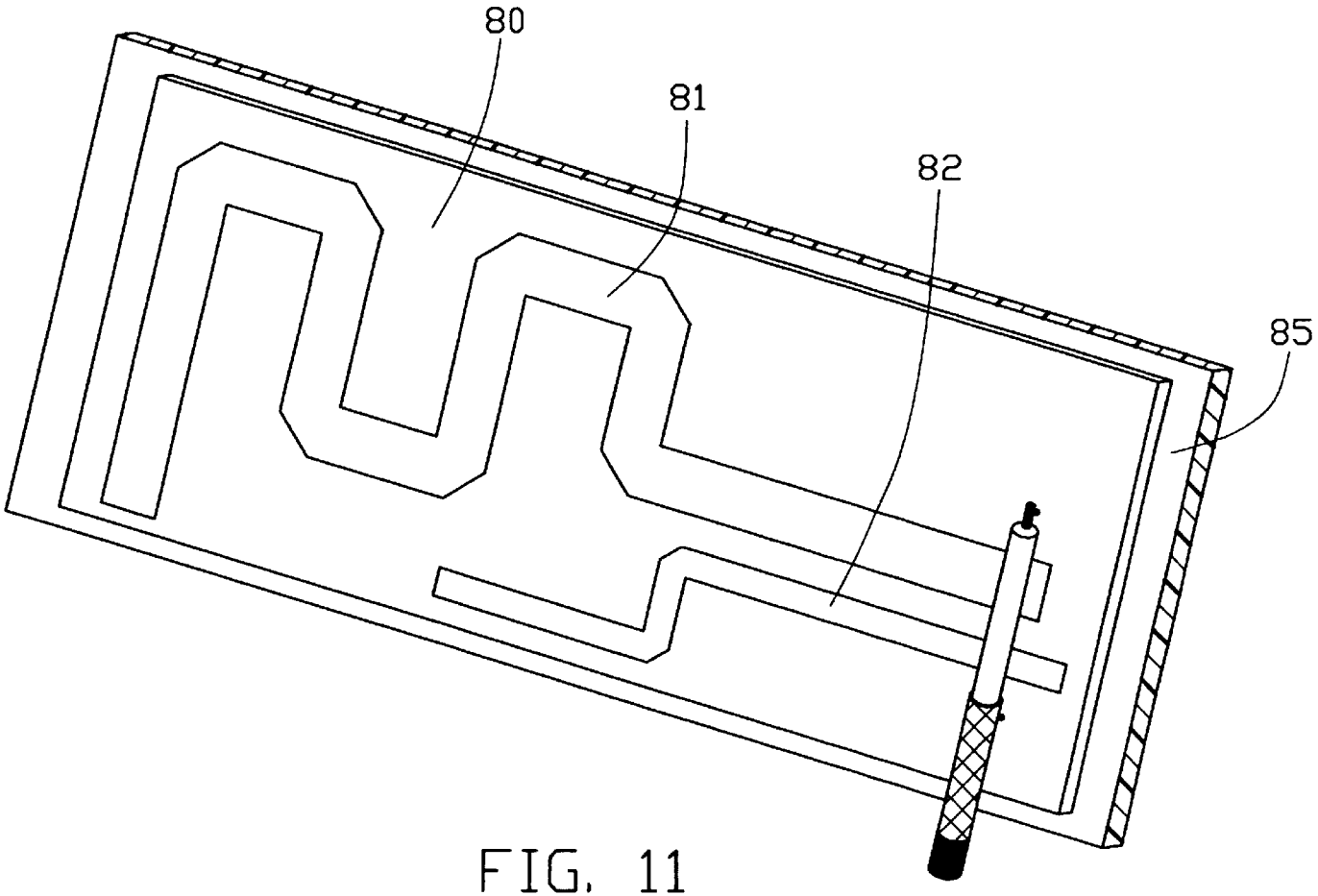
FIG. 11 is an assembled view of a third embodiment of a dual band slot antenna in accordance with the present invention.
Figure 12:
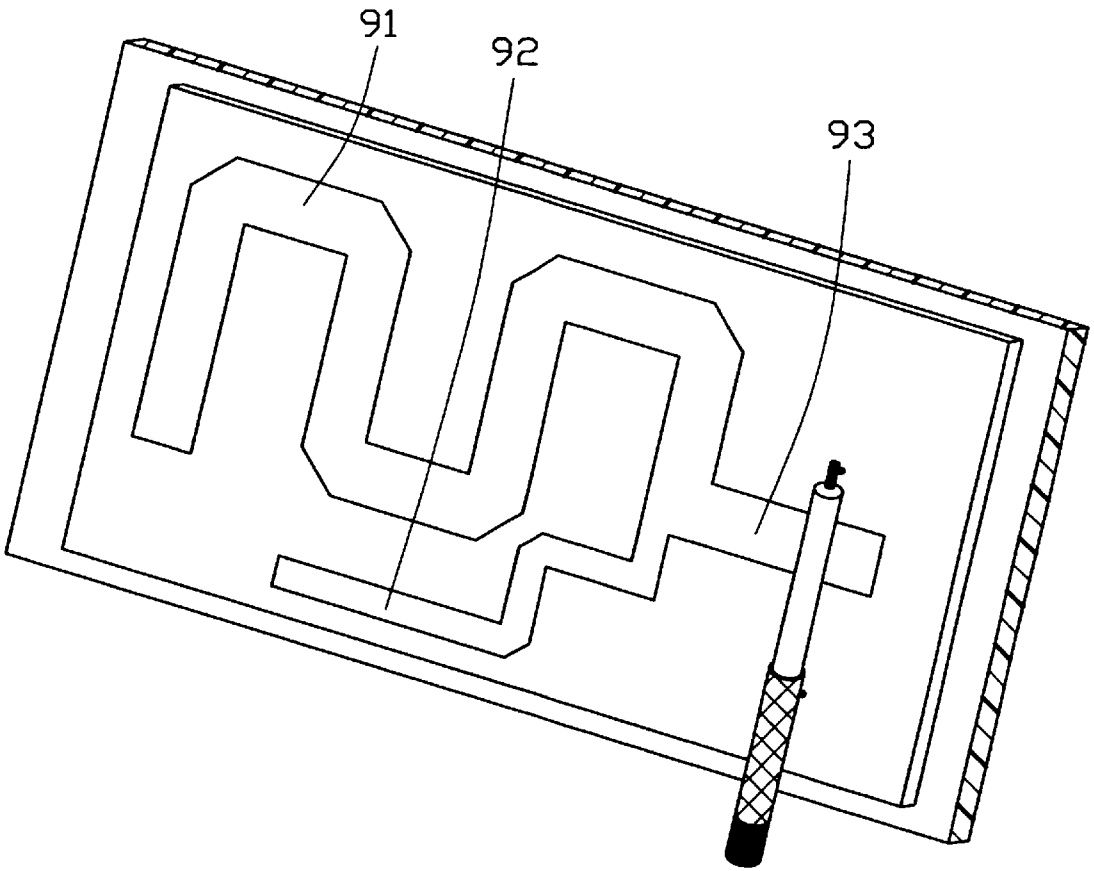
FIG. 12 is an assembled view of a fourth embodiment of a dual band slot antenna in accordance with the present invention.

In addition, to adapt a dual band slot antenna of the present invention to different installation spaces, the profile of the dual band slot antenna can be changed by changing the profile of slots in the antenna body. Referring to FIG. 11, two meandering slots 81, 82 can be defined in a conductive cladding layer 80 on a PCB 85. Referring to FIG. 12, two meandering slots 91, 92 intercommunicate at a common end 93 and an inner core and a braiding layer of a coaxial cable (not labeled) are respectively soldered to two opposite sides at the common end.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual band slot antenna for an electronic device, comprising:

a conductive antenna body with elongated first and second slots defined therein; and a coaxial feeder cable having a conductive inner core wire and a conductive outer shield, and a dielectric layer between the inner core wire and the outer shield, wherein the inner core wire is electrically connected to the antenna body at an outer side of the first slot and the outer shield is electrically connected to the antenna body at an opposite, outer side of the second slot.

2. The dual band slot antenna as claimed in claim 1, wherein the first and second slots have different dimensions.

3. The dual band slot antenna as claimed in claim 2, wherein the first and second slots do not intercommunicate.

4. The dual band slot antenna as claimed in claim 2, wherein the first and second slots intercommunicate at a common end.

5. The dual band slot antenna as claimed in claim 4, wherein the conductive inner core wire and the conductive outer shield of the coaxial cable are respectively connected to two opposite sides of the slot at the common end.

6. The dual band slot antenna as claimed in claim 1, wherein the first and second slots are straight in shape.

7. The dual band slot antenna as claimed in claim 1, wherein the first and second slots are meander in shape.

8. The dual band slot antenna as claimed in claim 1, wherein the antenna body is a conductive cladding layer deposited on a printed circuit board substrate, and the first and second slots are etched through the conductive cladding layer.

9. The dual band slot antenna as claimed in claim 8, wherein the first and second slots are meander in shape.

10. A dual band slot antenna comprising:

a conductive planar body defining therein first and second slots with different configurations therebetween; and a coaxial feeder cable including an inner core wire and a conductive outer shield with a dielectric layer therebetween;

said inner core wire being mechanically and electrically connected to a first position of said conductive body and the outer shield being connected to a second position of said conductive body; wherein said first position and said second position commonly defining a connection region, are respectively located by two opposite outer sides of said first and second slots under a condition that said coaxial feeder cable crosses both said first slot and said second slot around said connection region.

11. The antenna as claimed in claim 10, wherein said first slot and said second slot are substantially parallel to each other around said connection region.

12. The antenna as claimed in claim 10, wherein said first slot and said second slot are joined with each other around said connection region.

13. The antenna as claimed in claim 10, wherein at least one of said first slot and said second slot defines an end terminating around said connection region.

14. The antenna as claimed in claim 10, wherein said first position and said second position commonly define therebetween a line perpendicular to both said first slot and said second slot.

15. A dual band slot antenna comprising:

a conductive planar body defining therein first and second slots with different configurations therebetween; and a coaxial feeder cable including an inner core wire and a conductive outer shield with a dielectric layer therebetween;

said inner core wire being mechanically and electrically connected to a first position of said conductive body and the outer shield being connected to a second position of said conductive body; wherein said first position and said second position commonly defining a connection region, are respectively located by two opposite sides of at least one of said first and second slots under a condition that said first slot and said second slot are joined with each other at somewhere.

16. The antenna as claimed in claim 15, wherein said somewhere is close to the connection region.

* * * * *